US008668021B2

(12) United States Patent
Duong

(10) Patent No.: US 8,668,021 B2
(45) Date of Patent: Mar. 11, 2014

(54) ENERGIZING RING NOSE PROFILE AND SEAL ENTRANCE

(75) Inventor: Khanh A. Duong, Sugar Land, TX (US)

(73) Assignee: Vetco Gray Inc., Houston, TX (US)

( * ) Notice: Subject to any disclaimer, the term of this patent is extended or adjusted under 35 U.S.C. 154(b) by 360 days.

(21) Appl. No.: 12/912,487

(22) Filed: Oct. 26, 2010

(65) Prior Publication Data

US 2012/0098203 A1 Apr. 26, 2012

(51) Int. Cl.
*E21B 33/12* (2006.01)

(52) U.S. Cl.
USPC ..... 166/387; 166/348

(58) Field of Classification Search
USPC ..... 277/328, 337–339; 166/387, 338, 340, 166/348, 360, 368, 243
See application file for complete search history.

(56) References Cited

U.S. PATENT DOCUMENTS

| | | | | |
|---|---|---|---|---|
| 4,742,874 | A * | 5/1988 | Gullion | 166/348 |
| 5,456,314 | A | 10/1995 | Boehm, Jr. et al. | |
| 2010/0116489 | A1 | 5/2010 | Nelson | |
| 2010/0300705 | A1 | 12/2010 | Nelson | |

FOREIGN PATENT DOCUMENTS

| | | | |
|---|---|---|---|
| EP | 2314828 | A2 | 4/2011 |
| GB | 2126629 | A | 3/1984 |
| GB | 2462520 | A | 2/2010 |

OTHER PUBLICATIONS

GB Search Report dated Dec. 22, 2011 from corresponding Application No. GB1118176.5.

* cited by examiner

*Primary Examiner* — Giovanna Wright
*Assistant Examiner* — Ronald Runyan
(74) *Attorney, Agent, or Firm* — Bracewell & Giuliani LLP

(57) ABSTRACT

A wellhead seal assembly that forms a metal-to-metal seal between inner and outer wellhead members. A metal seal ring has inner and outer walls separated by a slot. An elastomeric seal is located below the seal ring and has a bottom portion that contacts an upward facing shoulder of a hanger. An energizing ring with a tapered nose is moved into the slot. The tapered nose has a compound angle that determines how much the nose travels into the slot when a force is applied to the energizing ring. Once the elastomeric seal is compressed to a desired level, the load on the energizing ring has increased to the point that the tapered nose of the energizing ring will further enters the slot and force the outer and inner walls of the metal seal into sealing engagement with the inner and outer wellhead members.

16 Claims, 5 Drawing Sheets

ENERGIZING RING NOSE PROFILE AND SEAL ENTRANCE

FIELD OF THE INVENTION

This invention relates in general to wellhead assemblies and in particular to an energizing ring nose profile that allows increased compression of a seal before a U-seal is locked down.

BACKGROUND OF THE INVENTION

Seals are used between inner and outer wellhead tubular members to contain internal well pressure. The inner wellhead member may be a casing hanger located in a wellhead housing and that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member. In addition to the seal between the inner and outer wellhead members, another annular seal, or emergency seal, may be located below this seal.

A variety of seals located between the inner and outer wellhead members have been employed in the prior art. FIG. 1 shows a portion of a seal assembly in the prior art within a wellhead housing 10. Housing 10 is typically located at an upper end of a well and serves as an outer wellhead member. An energizing ring 2 is typically forced downward by a running tool or the weight of a string to force it into a slot 3 defined by a U-type metal seal ring 4. This deforms inner and outer walls of the seal ring 4 apart into respective sealing engagement with inner and outer wellhead members 15, 10. The energizing ring is typically a solid wedge-shaped member. The deformation of the inner and outer walls exceeds the yield strength of the material of the seal ring 4, making the deformation permanent. Prior art seals may also include elastomeric and partially metal and elastomeric rings. Prior art seal rings made entirely of metal for forming metal-to-metal seals are also employed.

The seals may be set by a running tool, or they may be set in response to the weight of the string of casing or tubing. Located below the seal ring 4 is an emergency seal 5, in case seal ring 4 fails, that rests on a shoulder 6 formed on an inner wellhead member, such as a hanger 15. The emergency seal 5 may be fabricated from metallic, non-metallic, or elastomeric materials, or a combination thereof. The emergency seal 5 may be compressed when downward force from the string is applied to the energizing ring 2 to thereby cause emergency seal 5 to bulge outwards to contact the inner and outer wellhead members 15, 10 at a point below the seal ring 4 above. However, the energizing ring 2 also deforms the metal seal ring 4 against the outer wellhead member 10 and the inner wellhead member 15. If the metal seal ring 4 is deformed against the inner and outer wellhead members 15 and 10 before the emergency seal 5 is compressed sufficiently to bulge outwards against the outer wellhead member 10, then the emergency seal 5 may not be able to perform its function as an emergency seal and pressure integrity may diminish.

A need exists for a technique that addresses the seal leakage problems described above. In particular a need exists for a technique to compress an emergency seal a desired amount prior to deformation of the walls of the metal-to-metal seal. The following technique may solve these problems.

SUMMARY OF THE INVENTION

In an embodiment of the present technique, a seal assembly is provided that forms a metal-to-metal seal and has features that enhance sealability in the seal assembly. The seal assembly also includes features that enhance emergency or backup sealing capabilities. The seal ring has inner and outer walls separated by a slot and an elastomeric seal is located below the seal ring and has a bottom portion that contacts an upward facing shoulder of a hanger. A metal energizing ring has a tapered nose that may be pushed into the slot during installation to deform the inner and outer walls into sealing engagement with inner and outer wellhead members having wickers formed thereon. A radial gap exists between the outer wall of the seal and the inner wall of the mating housing. Such gap is required for installation in the field and is sufficiently large to require plastic deformation of the seal body, but not the energizer ring.

In an illustrated embodiment, the nose of the energizing ring has a compound angle configuration that can be tuned to allow a predetermined amount of force to be transmitted to the emergency seal below the seal ring. The compound angle also determines how much the nose travels into the slot when a force is applied to the energizing ring. This force and the accompanying reaction force from the shoulder of the hanger compresses the elastomeric seal to cause it to bulge outwards. The outward bulging of the elastomeric seal creates a seal between the inner surfaces of the inner and outer wellhead members. Once the elastomeric seal is compressed to a desired level, the load on the energizing ring has increased to the point that the tapered nose of the energizing ring will further enter the slot and force the outer and inner walls of the metal seal into sealing engagement with the inner and outer wellhead members. At this point, no additional compression of the elastomeric seal is possible.

In an example embodiment, the seal assembly also comprises the energizing ring that engages the slot. The retainer ring rests in a machined pocket on the outer surface of the energizing ring. The outer leg of the seal ring is machined with a taper that engages a taper formed on the retainer ring. The engagement ensures that the seal assembly remains intact as one solid structure during landing, setting, and retrieval operations. The retainer ring can alternatively rest in a machined pocket on the inner surface of the energizing ring to lock the seal onto the hanger.

The combination of stored energy provided for by the energizing ring, the compound angle configuration of the energizing ring nose, and the compressible elastomeric seal below the seal ring, advantageously provide enhanced emergency sealing if the metal-to-metal seal fails.

DETAILED DESCRIPTION OF THE INVENTION

Figure 2:
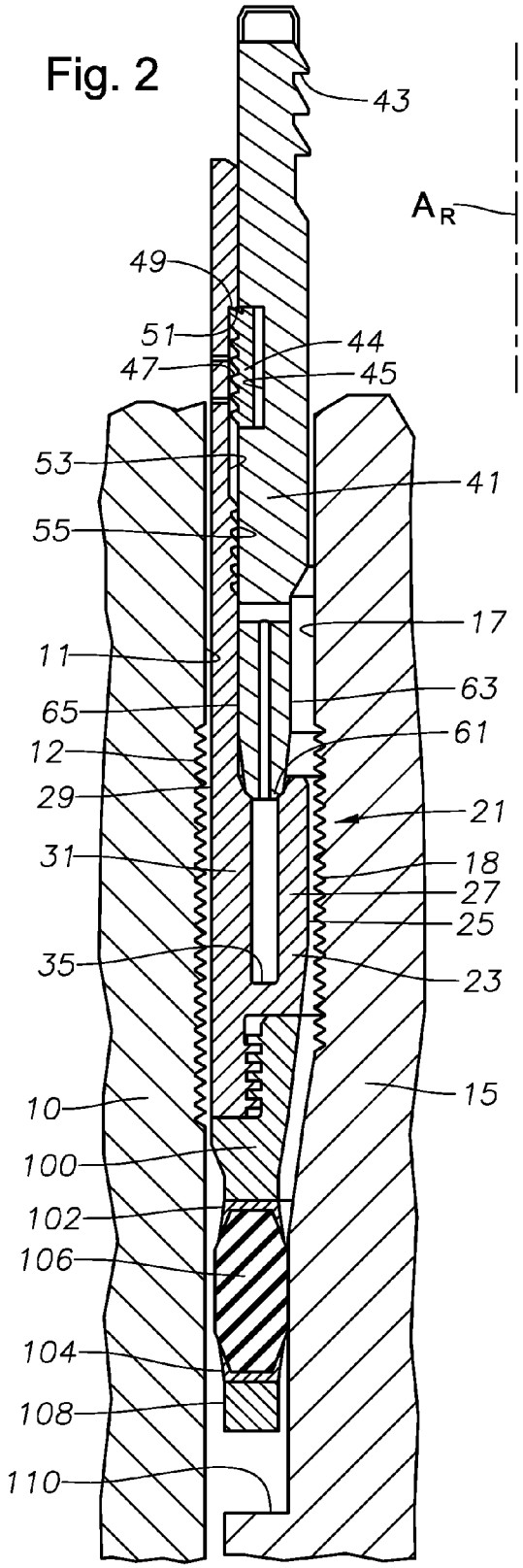
FIG. 2 is a sectional view of a seal assembly being lowered between outer and inner wellhead members, in accordance with an embodiment of the invention.

Referring to FIG. 2, an embodiment of the invention shows a portion of a wellhead assembly that includes a high pressure wellhead housing 10. In this example, the housing 10 is located at an upper end of a well and serves as an outer wellhead member of the wellhead assembly. Housing 10 has a bore 11 located therein. In this example, an inner wellhead member is a casing hanger 15, which is shown partially in FIG. 2 within bore 11. Alternately, wellhead housing 10 could be a tubing spool or a Christmas tree, and casing hanger 15 could instead be a tubing hanger, plug, safety valve, or other device. Casing hanger 15 has an exterior annular recess radially spaced inward from bore 11 to define a seal pocket 17. Wickers 12 are located on a portion of the wellhead bore 11 and wickers 18 are located on a portion of the cylindrical wall of seal pocket 17. In this example, the profiles of each set of wickers 12, 18 are shown as continuous profiles on the bore 11 and seal pocket 17. However, the wickers 12, 18 may be configured in other arrangements.

Continuing to refer to FIG. 2, a metal-to-metal seal assembly 21 is lowered between the housing 10 and casing hanger 15 and located in seal pocket 17. Seal assembly 21 includes a seal ring 23 formed of a metal such as steel. Seal ring 23 has an inner wall 25 that is an inner seal leg 27 for sealing against the cylindrical wall of casing hanger 15. Seal ring 23 has an outer wall surface 29 comprised of outer seal leg 31 that seals against wellhead housing bore 11. Each wall surface 25, 29 is cylindrical and smooth and engages the wickers 12, 18 when deformed against the bore 11 of the housing 10 and seal pocket 17 of the casing hanger 15. The wickers 12, 18 enhance the grip to aid in the prevention of axial movement of the seal assembly once set.

In the example FIG. 2, seal ring 23 is uni-directional, having an upper section only; however, a seal ring that is bi-directional may optimally be used. The upper section has a slot 35. The inner and outer surfaces forming slot 35 comprise generally cylindrical surfaces, that when viewed in an axial cross-section are generally parallel and each follow a straight line.

An annular energizing ring 41 engages slot 35 on the upper side. As shown, the energizing ring 41 has an axis $A_R$ that is substantially parallel with an axis (not shown) of the wellhead assembly. Energizing ring 41 is forced downward into slot 35 by a running tool (not shown) connected to grooves 43 on the inner diameter of upper energizing ring 41 during setting. Alternatively, seal assembly 21 and energizing ring 41 may be part of a string that is lowered into bore 11, the weight of which forces energizing ring 41 into slot 35. If retrieval is required, the grooves 43 can be engaged by a retrieving tool (not shown) to pull energizing ring 41 from set position. Energizing ring 41 can be formed of metal, such as steel. The mating surfaces of energizing ring 41 and outer seal leg 31 may be formed at a locking taper.

In an embodiment of the invention, an outwardly biased retainer ring 44 is carried in a pocket 45 on the outer surface of upper energizing ring 41. Ring 44 has grooves 47 on its outer surface and an edge that forms an upward facing shoulder 49. On the upper end of the outer seal leg 31 and on its inner surface, is a downward facing shoulder 51 that abuts against shoulder 49 of retainer ring 44, preventing energizing ring 41 from pulling out of seal ring 23 once the two are engaged.

Figure 3:
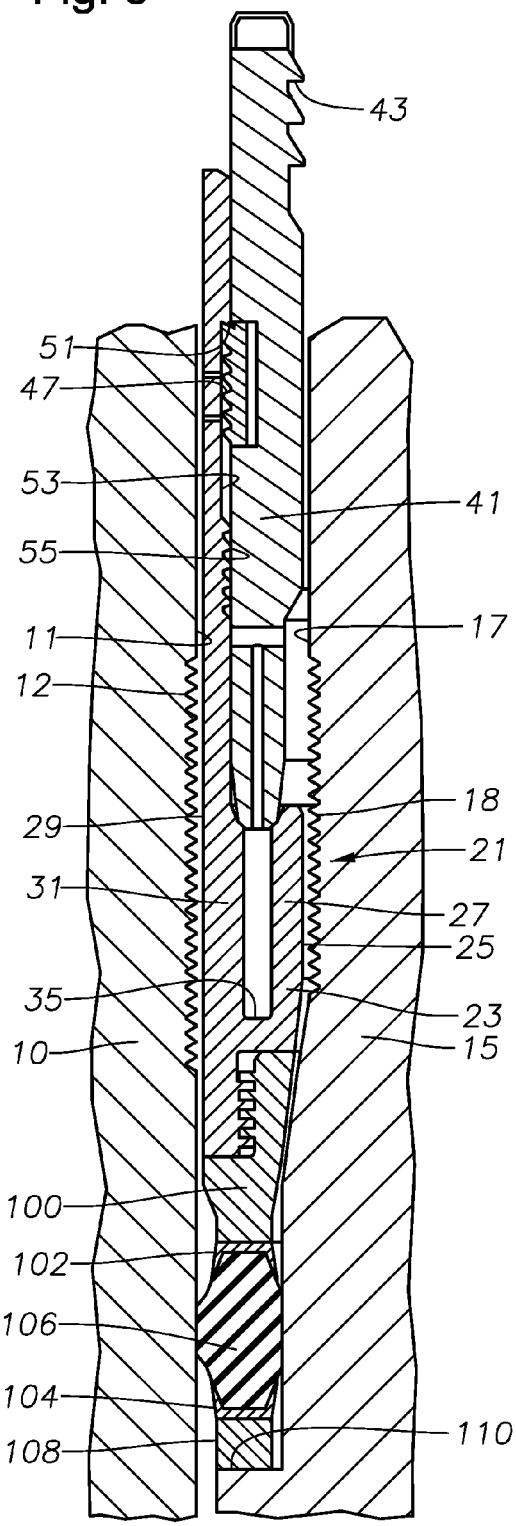
FIG. 3 is a sectional view of the seal assembly of FIG. 2 landed between outer and inner wellhead members in an unset position and with compression of an emergency seal, in accordance with an embodiment of the invention.
Figure 4:
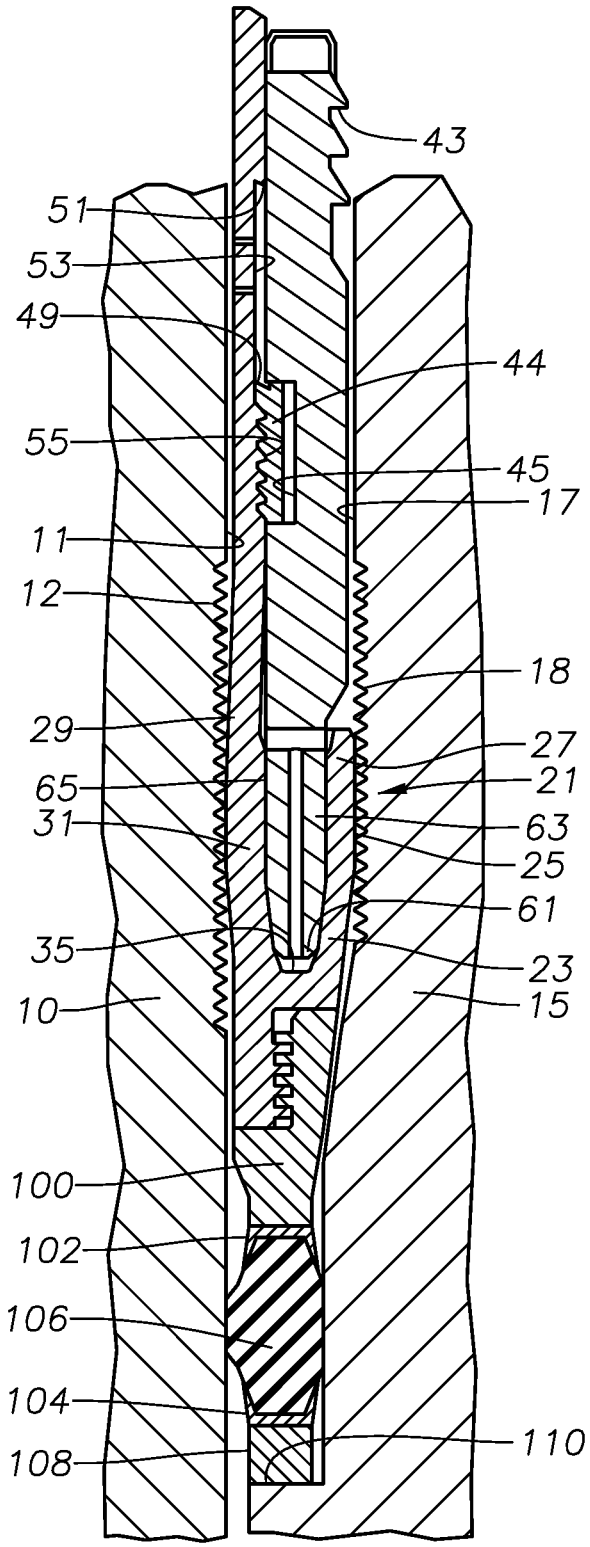
FIG. 4 is a sectional view of the seal assembly of FIG. 2 landed between outer and inner wellhead members in a set position, in accordance with an embodiment of the invention.

As shown in FIGS. 2, 3, and 4, a recess 53 is formed below shoulder 51 on the inner surface of outer seal leg 31. Grooves 55 are formed on the inner surface of outer seal leg 31 just below recess 53. Referring now to FIG. 4, the energizing ring 41 is put in a set position by downwardly ratcheting the ring 41 to align grooves 47 with grooves 55. When energizing ring 41 is set, as in FIG. 4, retainer ring 44 will move radially from pocket 45, and grooves 47 on the outer surface of retainer ring 44 will engage and ratchet by grooves 55 on the inner surface of outer seal leg 31, locking energizing ring 41 to seal ring 23. Retainer ring 44 can move downward relative to grooves 55, but not upward.

Energizing ring 41 has a nose 61 or engaging portion that engages slot 35. Energizing ring 41 has an inner surface 63 and an outer surface 65 for engaging the opposite inner sidewalls of slot 35 in seal ring 23. Inner and outer surfaces 63, 65 may be straight surfaces as shown, or optimally curved surfaces. Key features of the nose 61 of the energizing ring 41 are discussed in more detail in the description of FIGS. 5 and 6.

In the example embodiment of FIG. 2, a lower extension 100 secures by threads to the lower portion of seal ring 23. The lower extension 100 extends down and connects to an upper metal ring 102. The upper metal ring 102 may be bonded, soldered, welded, or fastened to the lower extension 100. In this example, the upper metal ring 102 together with a lower metal ring 104, hold an emergency or backup seal 106 in between. The emergency seal 106 may be bonded to both metal rings 102, 104 and may be fabricated from elastomeric, metallic, or non-metallic materials, or a combination thereof. In this example, a landing nose 108 is connected to the a back end of the lower metal ring 104 to facilitate landing on an upward facing shoulder 110 formed on the interior of the casing hanger 15. The shoulder 110 provides a reaction point during setting operations.

Figure 5:
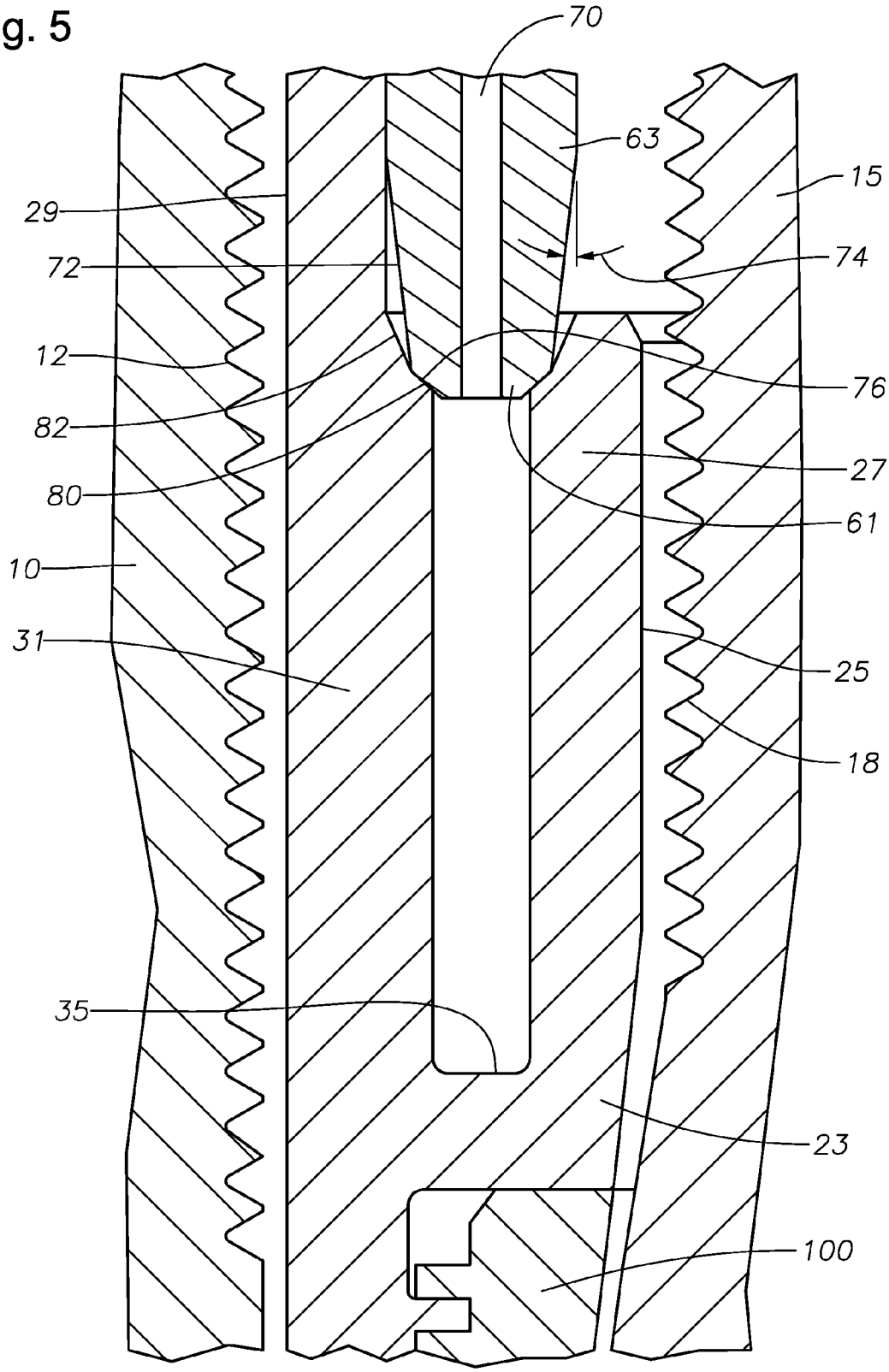
FIG. 5 is a sectional view of the nose of an energizing ring before entering the slot of a seal ring, in accordance with an embodiment of the invention.
Figure 6:
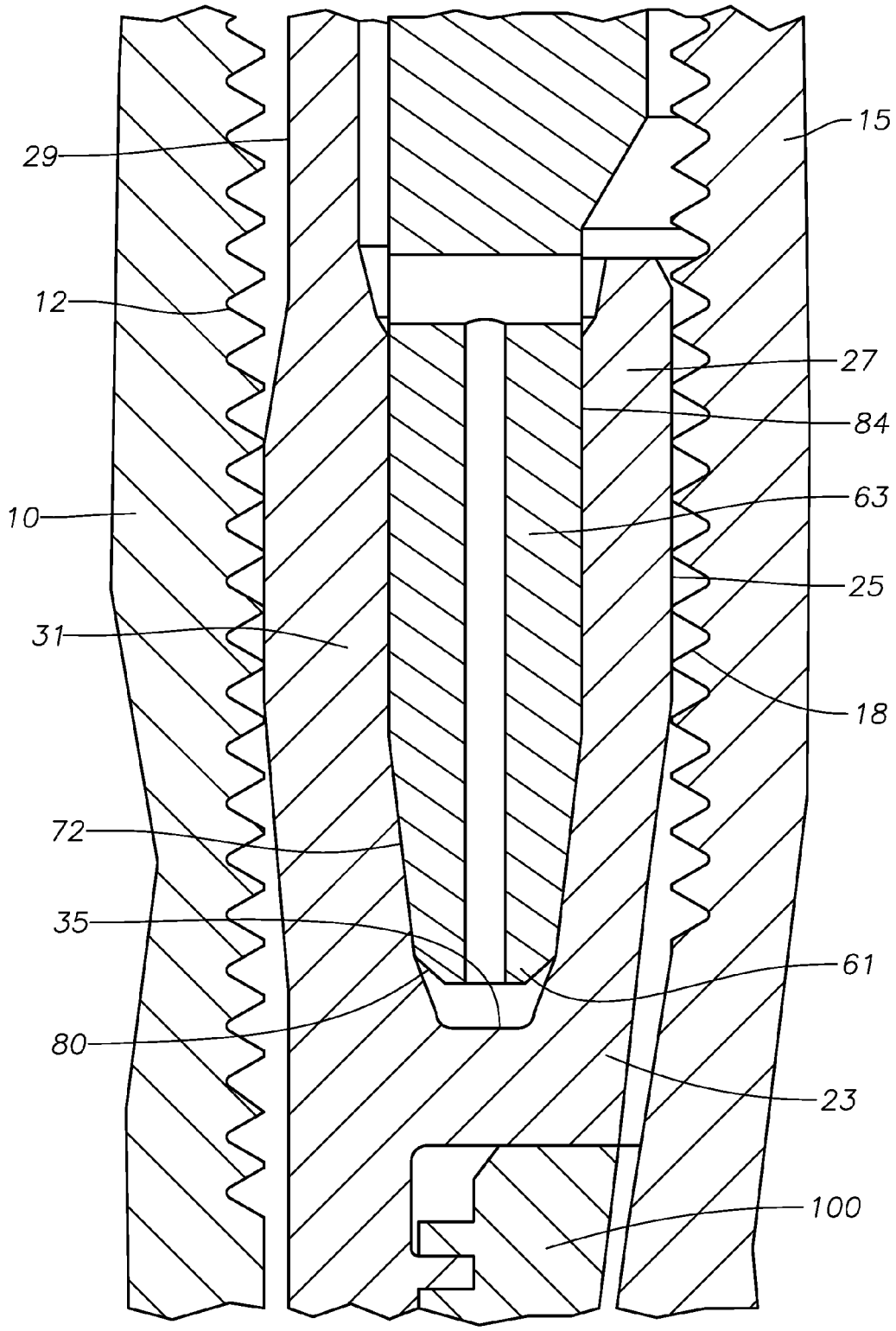
FIG. 6 is a sectional view of the nose of an energizing ring after entering a slot of a seal ring and deforming walls of the seal ring, in accordance with an embodiment of the invention.

Referring to FIGS. 5 and 6, an enlarged sectional view of the nose 61 of the energizing ring 63 is shown in the unset and set positions, respectively. The nose 61 may have a vent 70 to prevent hydraulic locking and may have a first tapered surface or portion 72 that tapers downwards at an angle 74 and have a second tapered surface or portion 80. The inner and outer legs 27, 31 of the seal ring 23 have tapered, upward facing shoulders 76, 82 at their upper ends and proximate the opening of the slot 35. The shoulders 76, 82 form a corresponding surface on which the second tapered surface 80 of the nose 61 rests when in the unset position. The taper of the first and second tapered surfaces 72, 80 form a compound angle that may be varied to achieve a delay in the entry of the energizing ring 63 into the slot 35 of the seal ring 23. For example, if less taper is provided to the second tapered surface 80 such that it is flatter, more force will be required to be applied to the energizing ring 41 (FIG. 2) to force the nose 61 into the slot 35 and consequently the emergency seal 106 will be compressed more than if a lesser force were applied. The second tapered surface 80 may vary in taper from 0 degrees (flat), which provides the most resistance, up to 90 degrees. The first tapered surface 72 may have a taper angle 74 that varies between 0 and 30 degrees. Various combinations of angles for both tapered surfaces 72, 80 may be used depending on the applications and may be affected by the material and construction of the emergency seal 106.

By delaying the entry of the energizing ring nose 61 into the slot 35 as force is applied to the energizing ring 41 (FIG. 2), setting of the legs 27, 31 of the seal ring 23 is delayed and the force is thereby transmitted to the shoulder 110 (FIG. 3) on the hanger 15, which acts as a reaction point. The force on the energizing ring 41 and the reacting force from the shoulder 110 (FIG. 3) thereby compress the emergency seal 106 (FIGS. 2-4) to cause it to bulge outwards until it forms a seal against the bore 11 of the housing 10 (FIG. 3). Once the emergency seal 106 is compressed sufficiently to bulge outwards against the outer wellhead member 10, the surface force between the second tapered surface 80 of the nose 61 and the upward facing shoulder 76 may be overcome by the force applied to the energizing ring 41 (FIG. 4) to thereby initiate the entry of the nose 61 into the slot 35. In an example embodiment, the first tapered surface 72 of the nose 61 is significantly more tapered than that of the second tapered surface 80 to facilitate entry of the nose 61 into the slot 35 and thereby deform the legs 27, 31 of the seal ring 23 against the wickers 12, 18 of the housing 10 and hanger 15. Once the legs 27, 31 are set, generally the elastomeric seal 106 (FIG. 4) cannot be compressed further. Control of the amount of compression in the elastomeric seal 106 (FIG. 4) can also be tuned by varying the surface area between the contacting surface of the second tapered surface 80 and the upward facing shoulder 76. A larger surface area at this contact surface may aid the delay of entry of the nose 61 into the slot 35.

Figure 1:
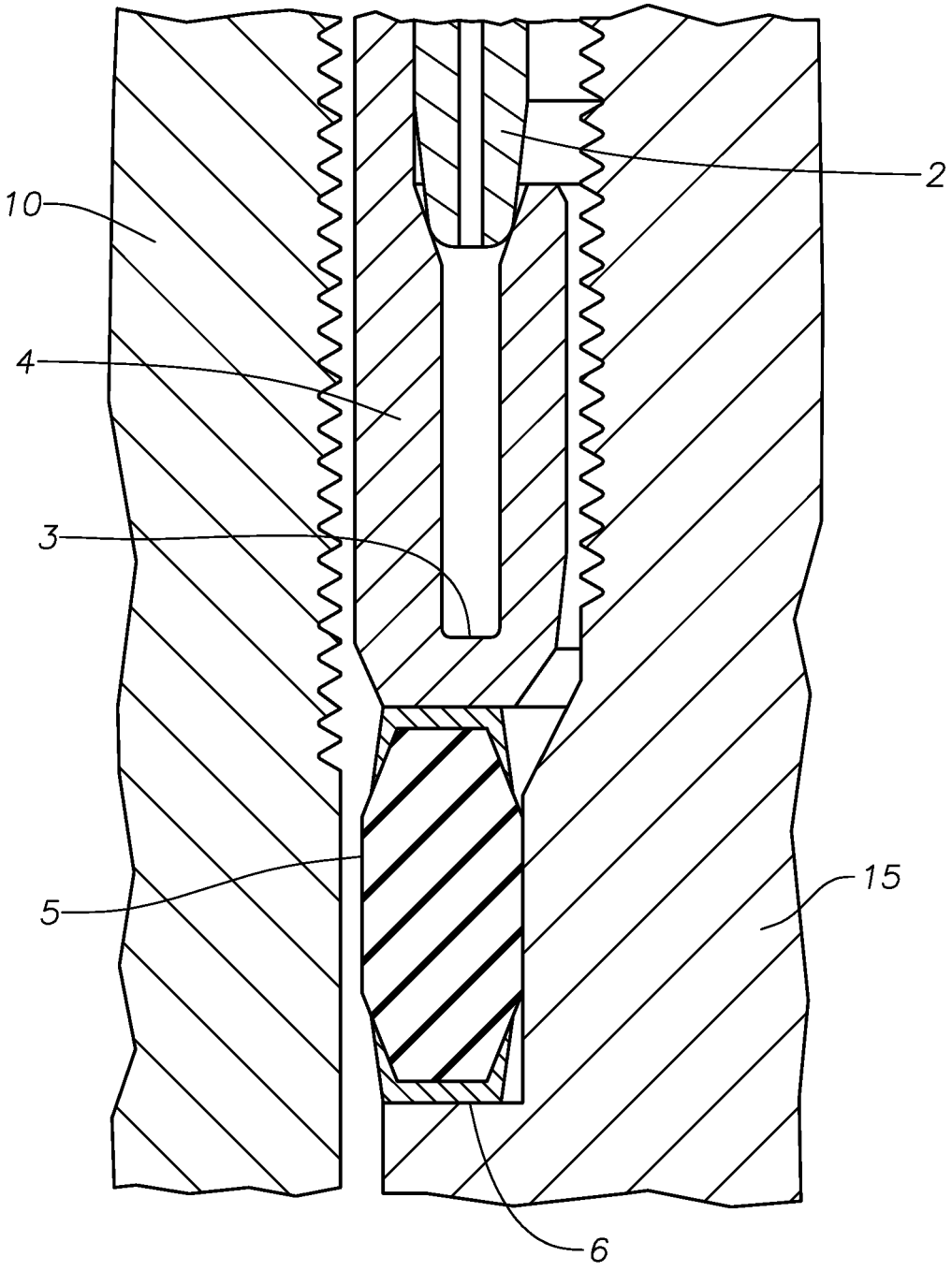
Fig. 1 (Prior Art)
FIG. 1 is a sectional view of a seal assembly of the prior art with an energizing ring locked to the seal, but unset, and with an emergency seal decompressed.

In an example of operation of the embodiment shown in FIGS. 2-6, a running tool or string (not shown) is attached to seal assembly 21 (FIG. 1) and lowered into the seal pocket 17 Seal assembly 21 may be pre-assembled with energizing ring 41, retainer ring 44, seal ring 23, extension 100, and emergency seal 106, all connected as shown in FIG. 2. The running tool or string (not shown) can be attached to grooves 43 on energizing ring 41. The outer wall 29 of outer seal leg 31 will be closely spaced to wickers 12 on the wellhead bore 11. The inner wall 25 of inner seal leg 27 will be closely spaced to the wickers 18 on the cylindrical wall of seal pocket 17. By pushing the energizing ring 41 downward (such as by the running tool) with sufficient force such that the second tapered surface 80 at the nose 61 of the energizing ring 41 transmit force via the upward facing tapered shoulders 76, down through the seal ring 23 to the emergency seal 106, to thereby compress the seal 106 as shown in FIG. 3. Compression of the emergency seal 106 causes it to bulge radially outwards and sealingly engage the bore 11 of the housing 10. After the seal 106 is compressed sufficiently to cause it to bulge outwards against the outer wellhead member 10, continued force is applied to the energizing ring 41 to overcome the surface forces between the second tapered surfaces 80 of the nose 61 and the tapered shoulders 76 of the seal ring 23, to insert the nose 61 in the slot 35. Urging the nose 61 into the slot 35 is facilitated by the first tapered surfaces 72 of the nose 61 because they have significantly more taper and thus less resistance than the second tapered surfaces 80. Further, engagement of nose 61 with the slot 35 causes the inner and outer seal legs 27, 29 to move radially apart from each other as shown in FIGS. 4 and 6. The inner wall 25 of inner seal leg 27 will embed into wickers 18 in sealing engagement while the outer wall 29 of outer seal leg 31 will embed into wickers 12 in sealing engagement. Once the inner and outer seal legs 27, 31 seal against the wickers 12, 18 of the wellhead members 10, 15, the emergency seal 106 can no longer be compressed.

During the downward movement of the energizing ring 41 relative to the seal assembly 21, the outwardly biased retainer ring 44 rides against recess 53. As shown in FIG. 4, as the wedge member 61 of the energizing ring 41 advances into slot 35, the retainer ring 44 and grooves 55 engage and ratchet by grooves 55 on the inner surface of seal leg 31. As a result, retainer ring 44 locks energizing ring 41 to seal ring 23 as shown in FIG. 4, preventing retainer ring 44 from working its way out of the seal ring 23. Vent passages or penetration holes 70 (FIG. 5) may be incorporated across wedge member 61 and through upper energizing ring 41 so that a hydraulic lock condition does not prevent axial make-up of the energizer and seal system.

Subsequently, during production, hot well fluids may cause the casing to grow axially due to thermal growth. If so, the casing hanger 15 may move upward relative to the wellhead housing 10. The inner seal leg 27 will move upward with the casing hanger 15 and relative to the outer seal leg 31. The retainer ring 44 will grip the grooves 55 to resist any upward movement of energizing ring 41 relative to outer seal leg 31. The wickers 12, 18 will maintain sealing engagement with the inner wall 25 of inner seal leg 27 and the outer wall 29 of outer seal leg 31.

If the seal formed by the wickers 12, 18 and the inner and outer seal legs 27, 31 is compromised due to excessive thermal growth cycles or higher operating pressures, then the emergency seal 106 can maintain seal integrity between the outer and inner wellhead members 10, 15.

In the event that seal assembly 21 is to be removed from bore 11, a running tool is connected to threads 43 on upper energizing ring 41. An upward axial force is applied to upper energizing ring 41, causing it to withdraw from slot 35 and retainer ring 44 to disengage grooves 55 on seal leg 31. However, due to retaining shoulders 49, 51, energizing ring 41 will remain engaged with seal ring 23, preventing the two from fully separating (FIG. 2).

In an additional embodiment (not shown), the wellhead housing 10 could be a tubing spool or a Christmas tree. Furthermore, the casing hanger 15 could instead be a lock-down hanger, tubing hanger, plug, safety valve or other device.

While the invention has been shown in only one of its forms, it should be apparent to those skilled in the art that it is not so limited but is susceptible to various changes without departing from the scope of the invention. For example, the seal could be configured for withstanding pressure in two directions, if desired, having two energizing rings. In addition, each energizing ring could be flexible, rather than solid.

What is claimed is:

1. A wellhead assembly with an axis, comprising:

an outer wellhead member having a bore;

an inner wellhead member in the bore;

an annular space between the inner and outer wellhead members;

a metal seal member having inner and outer annular walls defining a slot therebetween;

an annular energizing ring having a lower end with at least one first tapered surface at a first angle relative to an axis of the ring, and at least one second tapered surface joining and extending upward from the first tapered surface at a second angle relative to the axis of the ring, the second angle being less than the first angle, each of the first and second tapered surfaces being straight frusto-conical surfaces;

at least one upward facing shoulder on at least one of the inner and outer annular walls that has a first tapered portion that is a straight frusto-conical surface and at the first angle relative to the axis, the first tapered surface of the energizing ring mating in flush contact with the first tapered portion of the upward facing shoulder while the energizing ring is in an unset position;

wherein the energizing member is movable from the unset position into the slot to a set position with the second tapered surface in the slot, which moves the inner and outer annular walls apart from each other into sealing engagement with the inner and outer wellhead members;

an elastomeric seal member fastened to a lower end of the metal seal member;

a landing shoulder within the annular space onto which the elastomeric seal member lands; and wherein a downward force applied to the energizing ring while in the unset position transfers through the first tapered surface of the energizing ring to the first tapered portion of the upward facing shoulder in the metal seal member, causing the elastomeric seal member to sealingly engage the inner and outer annular wellhead members before the second tapered surface enters the slot.

2. The assembly according to claim 1, wherein the second tapered surface has a greater axial length than an axial length of the first tapered surface.

3. The assembly according to claim 1, wherein the inner and outer annular walls are cylindrical from a lower end of the slot to the upward facing shoulder while the energizing ring is in the unset position.

4. The assembly according to claim 3, wherein the inner and outer annular walls within the slot deform to define a tapered portion that matches the second tapered surface when the energizing ring is in the set position.

5. The assembly according to claim 1, wherein:

the at least one first tapered surface comprises an outer first tapered surface on an outer side of the energizing ring and an inner first tapered surface on an inner side of the energizing ring;

the at least one second tapered surface comprises an outer second tapered surface on the outer side of the energizing ring and an inner second tapered surface on the inner side of the energizing ring; and the at least one upward facing shoulder comprises an inner upward facing shoulder on the inner wall in the slot and an outer upward facing shoulder on the outer wall in the slot.

6. The assembly according to claim 1, further comprising:

a lower extension member integrally formed with the metal seal member and extending downward from one of the inner and outer annular walls; wherein the elastomeric seal member has an elastomeric seal element and an upper extension member extending upward from the elastomeric seal element alongside and secured to the lower extension member.

7. The assembly according to claim 1, wherein the upward facing shoulder has a second tapered portion extending upward from the first tapered portion at a lesser angle relative to the axis than the first tapered portion.

8. The assembly according to claim 7, wherein the angle of the second tapered portion of the upward facing shoulder is greater than the second angle of the second tapered surface of the energizing ring.

9. A wellhead assembly with an axis, comprising:

an outer wellhead member having a bore;

an inner wellhead member in the bore;

an annular space between the inner and outer wellhead members;

a metal seal member having inner and outer annular walls defining a slot therebetween;

an upward facing shoulder on each of the annular walls at an upper end of and within the slot, each of the upward facing shoulders having a first tapered portion that is a straight frusto-conical surface formed at a first angle oblique to an axis of the metal seal member;

an annular energizing ring having a lower end with a first tapered surface on inner and outer sides of the energizing ring, each of the first tapered surfaces being a straight frusto-conical surface at the same first angle as the first tapered portions of the upward facing shoulders so as to mate in flush contact with the first tapered portions while the energizing ring is in an unset position;

a second tapered surface joining and extending upward from the first tapered surface on each of the inner and outer sides of the energizing ring, each of the second tapered surfaces being at a second angle relative to the axis that is less than the first angle;

an elastomeric seal member fastened to a lower end of the metal seal member;

a landing shoulder within the annular space onto which the elastomeric seal member lands; wherein a downward force applied to the energizing ring while in the unset position transfers through the mating first tapered surfaces and first tapered portions and through the metal seal member to the elastomeric seal member to cause the elastomeric seal member to set between the inner and outer annular wellhead members before the energizing ring moves downward from the unset position into the slot; and continuing downward force causes the energizing ring to enter the slot to a set position, which forces the inner and outer annular walls into sealing engagement with the inner and outer wellhead members.

10. The assembly according to claim 9, further comprising:

a second tapered portion extending upward from the first tapered portion of each of the upward facing shoulders, each of the second tapered portions being a straight frusto-conical surface at a lesser angle relative to the axis than the first angle.

11. The assembly according to claim 10, wherein the angle of each of the second tapered portions is greater than the second angle of each of the second tapered surfaces of the energizing ring.

12. The assembly according to claim 9, wherein the inner and outer annular walls within the slot deform to define a tapered portion that matches the second tapered surface when the energizing ring is in the set position.

13. A method for sealing an annular space between inner and outer wellhead members of a wellhead assembly, the annular space having a landing shoulder, the method comprising:

providing a metal seal member having inner and outer annular walls defining a slot therebetween and an upward facing shoulder at an upper end of the slot having a first tapered portion that is a straight frusto-conical surface at a first angle relative to an axis of the seal member, an annular energizing ring having a lower end with a first tapered surface that is a straight frusto-conical surface at the same first angle, and a second tapered surface at a second angle relative to the axis that is less than the first angle;

securing an elastomeric seal member on a lower end of the metal seal member to define a seal assembly and placing the energizing ring in an unset position with the first tapered surface of the energizing ring in flush, mating contact with the first tapered portion of the upward facing shoulder;

inserting the seal assembly into the annular space and landing the elastomeric seal member on the landing shoulder;

applying a downward force on the energizing ring to cause the elastomeric seal member to seal between the inner and outer wellhead members while the energizing ring remains in the unset position; then inserting the energizing ring into the slot by increasing the downward force on the energizing ring, causing the second tapered surface to enter the slot and force the inner and outer walls into sealing engagement with the inner and outer wellhead members.

14. The method according to claim 13, further comprising providing the upward facing shoulder with a second tapered portion extending upward from the first tapered portion at a lesser angle relative to the axis than the first angle.

15. The method according to claim 14, wherein the angle of the second tapered portion is greater than the second angle of the second tapered surface of the energizing ring relative to the axis.

16. The method according to claim 13, wherein the step of providing the energizing ring with first and second tapered surfaces comprises forming the first and second tapered surfaces on both inner and outer sides of the energizing ring.

* * * * *